United States Patent [19]

Mainwaring et al.

[11] Patent Number: 4,539,010

[45] Date of Patent: Sep. 3, 1985

[54] COAL PREPARATION

[75] Inventors: David E. Mainwaring; Charles U. Jones, both of Melbourne, Australia

[73] Assignees: Australia Limited; The Broken Hill Proprietary Company Limited, both of Australia

[21] Appl. No.: 566,874

[22] Filed: Dec. 23, 1983

[30] Foreign Application Priority Data

Dec. 24, 1982 [AU] Australia ..... PF07458

[51] Int. Cl.[3] ..... C10L 9/08; C10L 5/22

[52] U.S. Cl. ..... 44/1 C; 44/2; 241/38

[58] Field of Search ..... 44/1 C, 2; 241/16, 19, 241/38; 209/133

[56] References Cited

U.S. PATENT DOCUMENTS

| | | | |
|---|---|---|---|
| 1,576,335 | 3/1926 | Kreising | 241/19 X |
| 2,738,263 | 3/1956 | Peery et al. | 48/206 |
| 2,768,938 | 10/1956 | Martin | 241/19 X |
| 3,895,760 | 7/1975 | Snyder | 241/5 |
| 3,973,733 | 8/1976 | Switzer | 241/1 |
| 4,219,404 | 8/1980 | Dickakian | 208/39 |
| 4,239,496 | 12/1980 | Cochran | 44/51 |
| 4,294,584 | 10/1981 | Verschuur | 44/2 X |
| 4,396,396 | 8/1983 | Mainwaring | 44/24 |
| 4,402,706 | 9/1983 | Wunderlich | 44/2 X |
| 4,415,335 | 11/1983 | Mainwaring et al. | 44/1 |

FOREIGN PATENT DOCUMENTS

| | | | |
|---|---|---|---|
| 1242148 | 8/1971 | United Kingdom | 44/2 |

*Primary Examiner*—Carl F. Dees

*Attorney, Agent, or Firm*—Sheridan, Ross & McIntosh

[57] ABSTRACT

A method of preparing fine particulate coal for power generation on which the coal is pretreated by the oil agglomeration method (10, 11) to increase the carbonaceous content and produce coal-oil agglomerates. These are fed to a fluidized bed (15) in which the fluid is steam. The bed as concentration is variable and agglomerates leaving the bed are disintegrated in a steam jet (21) which completes separation of the oil from the coal and forms the fine particle coal feed. The oil and steam are separated from the coal feed which continues in the fuel delivery system 29 to the power generation plant. The only steam mix is condensed 37 and the two phases separated (39) and recycled for further use. A control means is provided which is responsive to steam generation demand and activates changes in the generation of coal oil agglomerates (10, 11) and the discharge of coal particles from the fluid bed, disintegrator 15, 21.

14 Claims, 4 Drawing Figures

COAL PREPARATION

Figure 1:
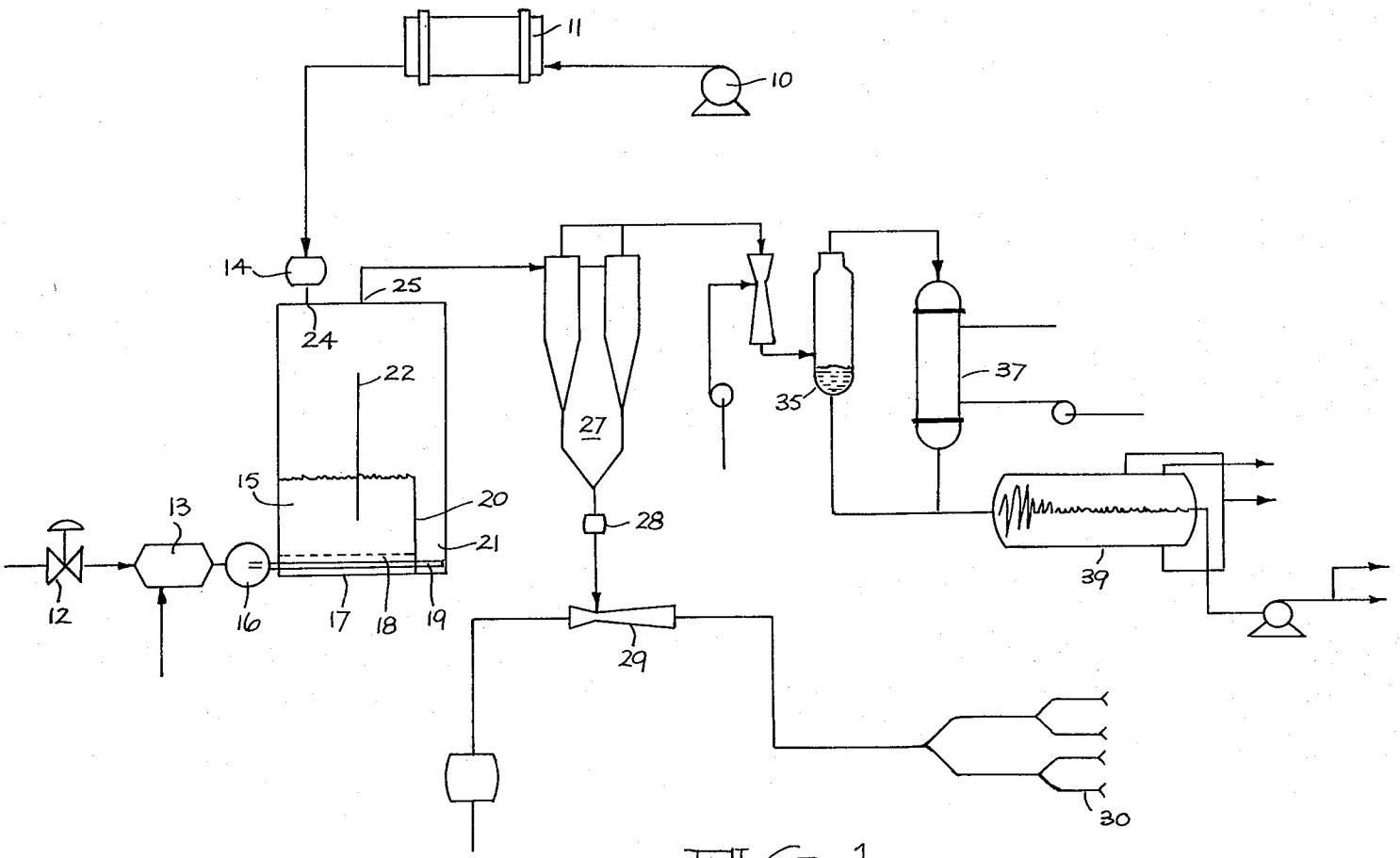

This invention relates to the preparation and delivery of coal in particulate form to burners in power generating plants.

Australian patent application No. 70748/81 (based on PCT AU 81/0-0055) and U.S. Pat. No. 4,396,396 both assigned to the assignee of this invention, disclose methods of deashing coal using an oil agglomeration technique with recovery and recycling of the oil.

Application No. 70748/81 in particular discloses a process for obtaining finely divided coal particles by the steps of oil agglomeration and oil recovery under conditions which disintegrate the agglomerates into fine particles suitable for power generation burners. The oil recovery is achieved by steam stripping and preferably by introducing agglomerates into a high velocity stream of steam disintegration is achieved at the same time.

U.S. Pat. No. 4,396,396 was concerned with steam tripping of agglomerates in a fluidized bed without destruction of the agglomerates. Relatively longer residence times are required in the fluidized bed system to achieve a desired oil reduction but the variation in oil reduction between individual agglomerate samples is greater than that achieved in the entrained disintegration system of application No. 70748/81.

Other patents generally concerning with the production of particulate coal are (1) U.S. Pat. No. 3,973,733 (Switzer) which disintegrates coal particles by impregnating them with steam in a closed vessel and subsequently releasing the pressure to disintegrate the particles; (2) U.S. Pat. No. 2,738,263 (PEERY) which discloses a method of conveying coal particles in a carrier of steam to a partial combustion chamber used to produce a hydrogen and carbon monoxide synthesis gas mixture; and (3) U.S. Pat. No. 3,895,760 which describes a general process for comminuting mineral by mechanical shock.

In preparing fuel for power generation it is generally desirable to prepare the fine particulate coal immediately prior to its introduction to the burners in order to avoid large scale storage of coal fines. Thus it is desirable if possible to have a coal preparation plant which is responsible to the varying coal feed requirements of the burners so that steam production can be readily controlled.

Accordingly it is an object of this invention to provide a method of preparing fine particulate coal suitable for use in power generation plants which method is also susceptible to output control with short response times where this is needed.

To this end the present invention provides a method of preparing fine particulate coal for use in power generation which comprises crushing mined coal into small sized particles, wetting said fine coal particles with a hydrocarbon liquid and forming carbonaceous agglomerates of said fine particles, separating said carbonaceous agglomerates from non-carbonaceous material present in said coal, passing said agglomerates into a fluidized bed which is fluidized with steam in the absence of oxygen to remove a portion of said hydrocarbon liquid, subsequently passing said treated agglomerates into a high velocity stream of steam to disintegrate said agglomerates into fine particles of coal and remove a further portion of said dehydrocarbon liquid, and subsquently separating out said fine coal particles and condensing said steam and hydrocarbon liquid to allow recovery and recycling of said hydrocarbon liquid. It is possible to control the rate of production of the coal particles by controlling the rate at which agglomerates are fed to the fluidized bed and by controlling the velocity and temperature of the steam used in the fluidized bed. The fluidized bed can be increased in capacity and output and once the flow of treated agglomerates increases this is immediately transformed into a higher production of coal fines. The residence time of the fluidized bed is relatively long compared to that of the disintegration and entrainment step. By using the fluidized bed as a weir agglomerates can be held for varying periods. When an increase in coal output is required the residence time can be varied by either increasing the rate of feed for the agglomerates or increasing the velocity of the steam in the fluidized bed.

The present invention also provides apparatus for preparing fine coal particles for use in power generation, comprising a source of coal-hydrocarbon liquid agglomerates a fluidized bed having at its lowest part an inlet for steam and in its upper portion an inlet for said coal agglomerates and an outlet for agglomerates intermediate the height of said fluidized bed, said outlet feeding said treated agglomerates into a tubular conveyor having a high velocity steam inlet at one end and a means for separating out fine coal particles from said steam at the other end.

Preferably the coal cleaning plant provides the source for the agglomerates. The delay in increasing output is greatest in the cleaning plant. Another aspect of this invention is the control arrangement which includes means in the power generation plant sensing steam production which actuates an increase in output of coal agglomerates from the coal-cleaning plant (agglomeration and separation) and also increases the velocity and/or temperature of steam in the fluidized bed. The effect of the fluidized bed is to increase the output of treated agglomerates to the entrained disintegration conveyor almost immediately due to the stream increase and this increase in output is then maintained by the subsequent increase in agglomerates entering the fluid bed.

A preferred embodiment of this invention will now be described.

Figure 2:
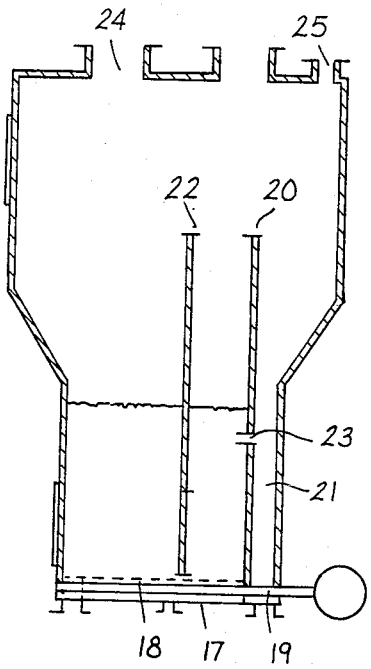
Figure 4:
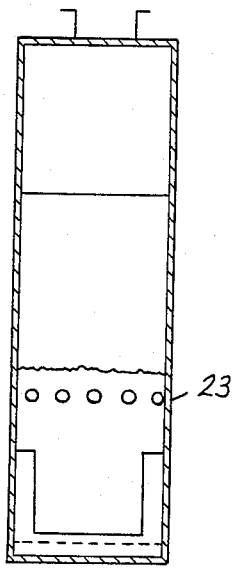
Figure 3:
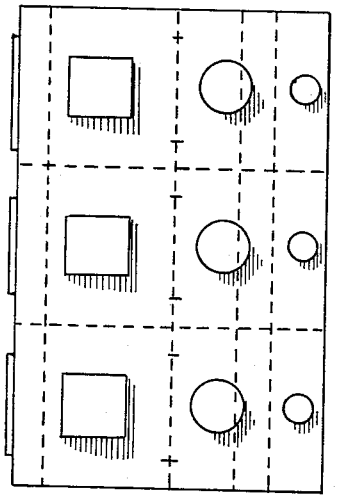

The flow sheet of FIG. 1 illustrates a plant configuration for a power plant and FIGS. 2, 3 and 4 detail the design of the fluidized bed and the entrainment conveyor.

The objects of this plant design are:

Fuel is to be delivered to a number of burner rows such that (i) the boiler can operate with one, more than one or all burner rows supplied with fuel from the coal preparation plant;

(ii) boiler fuel rates can be modulated through the preparation plant such that normal load changes are accommodated;

(iii) load drops of 50 to 100% resulting from trip conditions in the plant can be handled;

(iv) relative firing rates for individual burner rows can be varied to control furnace temperature profiles;

(v) no intermediate storage of fine particulate coal is required;

(vi) operation of the boiler on its conventional mode is not affected.

During normal operation of the boiler i.e. between half an full electrical load, all burner rows (4 burners per row) will be in operation. Variation in relative firing rates for the individual rows is such that the bottom row has the higher firing rate and the upper the lowest. The variation between firing rates is around 10% of the bottom row firing rate.

In order to accomplish independent firing of all burner rows the fluid bed stripper and downstream plant will operate as units in parallel. That is each burner row will have a dedicated slurry feed, fluid bed, cyclones, scrubber, condenser and fuel delivery system. The three fluid beds will be contained within one vessel but will be totally independent inclusive of steam supply. A single oil/water separator will be used for all condensate flows.

The process flow scheme is shown in FIG. 1 and comprises the following operations (i) agglomerate feed system (10,11)
(ii) steam supply and desuperheaters (13)
(iii) fluidized bed stripper (15,21)
(iv) gas-solid separation (27)
(v) gas clean-up (35)
(vi) condensation (37)
(vii) oil/water separation (39)
(viii) fuel delivery system (29)

Plant components not shown in this flow scheme are
(i) in-line emulsion system
(ii) boiler feed water treatment FIG. 1 shows the major flow lines only and does not include auxiliary water lines, sample points, pressure relief vents or similar details.

A detailed description of the process is now given with reference to the flow scheme of FIG. 1.

Coal-oil agglomerates produced as described in U.S. Pat. No. 4,396,396 are delivered under mass flow control from the existing Agglomerate Holding Tank by a variable speed drive slurry pump (10) to a dewatering screen 11. Delivery rates from each pump, thereby fixing the burner row firing rate, is controlled in response to variations in steam flow to the fluid bed. The boiler fuel demand as indicated by the boiler steam pressure deviation signal is used to control steam flow to the fluid beds. A bias is applied to the pressure deviation signal to establish each burner row firing rate relative to the others.

Dewatering agglomerates leaving the dewatering screen (11) are transferred into the fluid bed chamber via rotary seal valve (14). Solids flow after the dewatering screen is to be measured and the resultant signal used in the feedback loop for agglomerate delivery control. Back leakage of steam through the valves is to be minimized as any vapour lost from the fluid bed represents a loss of oil from the system. Valves should be capable of running at up to 220° C.

Bias setting for control of relative burner row firing rates is to be carried out from the control room by the plant operator, and is part of the existing plant.

Steam is to be taken from the superheater outlet header of the power generating boiler or other superheated steam source at a temperature above 400° C.

After the steam flow control valve 12, the steam may optically pass through a desuperheater 13. Under normal operating conditions the desuperheater will be inactive. Its purpose will be to act as a device limiting the maximum temperature possible within the fluid bed. The desuperheater shall be activated during continuous operation in response to a high bed temperature alarm condition which shall be set to around 200° C. to prevent coal devolatilisation.

Use of the desuperheater 13 is also made during start-up to limit thermal shock and pre-heat the oil recovery system prior to introduction of feed.

From the desuperheater the steam is passed directly to the fluid bed steam manifold 17. A measurement of steam flow shall be provided at 16 between the desuperheater outlet and manifold inlet.

Each fluid bed chamber will process, under normal boiler load conditions, at rates which correspond to the fuel requirements per burner row for between 50 and 100% of electrical output. Coal will enter the fluid bed as 3–4 mm spherical agglomerates and leave through outlet 23 entrained in the steam and oil vapours are fully disintegrated fine particulate material corresponding to the size produced in the wet ball mill prior to agglomeration, i.e. 98% less than 300 micron.

Placing of the fluid bed in service will require a preheating period at non-fluidising steam flows. Some fine coal will be entrained from the bed at this time and additional steam injected after the fluid bed or into the freeboard to maintain cyclone efficiencies if necessary. Transport velocities are not a problem as velocity increases between freeboard and transfer pipes overcome saltation effects in horizontal transport. One preheated the bed can be placed routinely into a fluidized state and feed started. Auxiliary oil burners will be utilised to maintain burner function until steady flow of fuel is achieved.

The effective mass of the fluid bed will be approximately fixed. As a result, mean residence times for coal in the fluid bed will vary from six minutes at full load to 12 minutes at half load. The bed depth will vary slightly with throughput based on the pressure drop across the discharge orifice in the baffle plate 20 dividing the fluid bed and attrition region 21.

Steam flows will be varied in response to the biased boiler steam pressure deviation signal. Since without activation of the desuperheaters the inlet steam temperature is fixed, heat input is directly proportional to steam flow. The heat load is set by the agglomerate feed rate and varies for a fixed feed rate with slight variations in composition. Some fluctuations in water content can be expected in the feed. Steam flow into the fluid bed will thus be set on the basis of the required steady state fuel rate demanded by the boiler for each burner row. Variations in feed composition will therefore cause variations in bed temperature. As these fluctuations are 'slow', long term drift can be compensated by bias setting adjustments to the measured steam flow signal.

A general arrangement of a fluid bed is shown in FIG. 2. In this embodiment three fluid beds are used each being a part of a flow scheme as shown in FIG. 1. Agglomerates enter the fluid bed vessel at 24 via a rotary seal valve as described above. The pellets fall through the freeboard of the vessel and into the first section of the fluid bed. Wet pellets are mixed, heated and partially de-oiled within the first section of the bed. Material from this first section flows via baffle plate 22 into the second section of the fluid bed. Constructions of the baffle plate ensures that no agglomerates entering the vessel can avoid being mixed within the first section of the fluid bed. Extension of the baffle into the freeboard prevents pellets depositing directly in the two downstream sections of the bed. Flow openings for the portion of the baffle within the fluid bed are positioned at the bottom of the bed therefore preventing short-circuiting to a large degree in both the first and second sections.

Agglomerate pellets enter the second section of the fluid bed via baffle opening and undergo further deoiling before passing to the third section of the vessel via a series of discharge orifices 23. These are located in wall 20 above the slumped bed level and below the minimum fluidised bed (controlled by a low position limit on the steam valve). In this last section the essentially de-oiled pellets are disintegrated by the action of steam jets 19 and the resultant fine particles of coal are entrained in compartment 21 in the vapours leaving the vessel through outlet 25.

Operation of the regions of the vessel as fluid bed or disintegration regions is controlled via the method of steam injection. Steam enters the vessel via a steam manifold and set of concentric pipe distributors. Orifices within the distributor are constructed to produce steam jets that, if allowed to contact essentially dry pellets, would cause them to break down to the constituent fine particulate. In the fluid bed region the distributor are submerged below a packing of steel balls (18) which act to prevent contact of agglomerates with the steam jets and to diffuse the jets within the voids in the ball packing. Contact velocities are in this way reduced from about 60 m/s to around 6–12 m/s dependent on steam rate. In the disintegration section, the ball packing is omitted allowing contact of agglomerates with the high jet velocities.

Breakdown of agglomerates does still occur to some extent within the fluid bed region 15 but can be considered instantaneous in the disintegration region 21. For this reason, and from cyclone performance considerations, complete shut-off of steam is essential if zero fuel is to be supplied to the burners. Rates of breakage within the fluid bed region will increase with fluidising velocity i.e. with bed turbulance. Agglomerate pellets will tend not to break down until they have had the oil removed from them, therefore breakage within the fluid bed does not represent a short circuiting problem. At the feed condition oil bearing agglomerates tend to deform under stress with the liquid oil films continuing to bind the particles. Fine material leaving the fluidised bed section is derived from pellets that have not escaped to the disintegration region but have circulated in the fluid bed region for a long enough period to have been de-oiled and broken down.

Pellets reaching the disintegration region 21 which still retain significant quantities of oil i.e. those that have spent less than the mean residence time in the bed, will still be de-oiled as these pellets will be retained in this region of the vessel until disintegrated. Adequate residence time exists for oil bearing fine particulate material to be de-oiled in the entrained state between the steam distributors and cyclone discharge (approximately 2 sec.) In fact heat balance considerations and control of solids temperatures require that the steam entering the disintegration region perform the same de-oiling duty per kilogram of steam as that entering the fluid bed region. That is, final de-oiling will occur in the entrained state and should ensure a more uniformly de-oiled fine particulate coal feed.

Steam and oil vapour with entrained de-oiled fine particulate material leave the fluid bed chambers via single transfer line and are delivered to the cyclone 27 inlet. Vapour velocities in these lines will range between 15 and 30 m/s at half and full load respectively. The solids collection system for each fluid bed chamber/burner row will comprise two cyclones operating in parallel.

Solids leaving the cones of each pair of cyclone are recombined and discharged into the fuel delivery system via a rotary seal valve 28. The rotary valve is to be sized such that it is over capacity at full load and operates at fixed speed. An important aspect of design of the fuel delivery system will be to provide as near as possible a pressure balance across the rotary valve. Any small leakage should be from the cyclone to the conveying system to ensure that aeration of the fine particulate ahead of the valve is avoided.

Overflow vapours from each pair of cyclones are to be recombined to a single transfer pipe and delivered to the gas clean-up (35) and condensation stages.

Saturated vapours leaving the scrubber cyclone 35 are passed to a vertical shell and tube condenser 37 where they are totally condensed.

Condensation and subcooling are to occur on the tube side in a single vertical pass. The choice of this configuration is made primarily to assist in the minimisation of tube fouling by coal fines.

Condensates leaving the condenser/sub-coolers 37 and the scrubber cyclones 35 are combined into a single flow and transferred to the liquids separator vessel 39. That is, one separator may service all three oil recovery trains.

The type of separator 39 envisaged is a horizontal cylindrical separator vessel with the oil/water mixture entering the tank at one end through a baffled inlet. Separated oil and water are removed from the vessel under gravity to the existing recycle oil tank and demineralised water tank respectively. Control of the oil/water interface level in the vessel is determined by the configuration of discharge lines which are also arranged to prevent siphoning of the vessel contents.

Auxiliary tubes and a pump may be provided for removal of material building up at the oil/water interface level in the vessel is determined by the configuration of discharge lines which are also arranged to prevent siphoning of the vessel contents.

Auxiliary lines and a pump may be provided for removal of material building up at the oil/water interface and on the bottom of the vessel. These systems will handle any excessive build-up of coal fines on an intermittent basis. The separator should be capable of handling small quantities of air.

Fuel for each row of burners is to be transferred from the dry cyclones 27 via a rotary seal valve 28 into a pneumatic conveying system 29 for delivery to the burners 30. The conveying gas will be air.

Fine particulate coal is to be conveyed from the cyclone 27 and rotary seal valves 28 located outside the boiler house to a point in front and level with the individual burner rows. At this point the conveying pipe is split in two ways, the resultant lines split two ways again and the fine coal introduced into the primary air line close to the burner inlet.

From the above it can be seen that the present invention provides a means of effectively recovering oil from coal agglomerates and producing particulate coal suitable for power generation in a manner which is susceptible to requirements for response to varying burner demands.

We claim:

1. A method of preparing fine particulate coal for use in power generation which comprises crushing mined coal into small sized particles, wetting said fine coal particles with a hydrocarbon liquid and forming carbonaceous agglomerates of said fine particles, separating said carbonaceous agglomerates from non-carbonaceous material present in said coal, passing said agglomerates into a fluidized bed which is fluidized with steam in the absence of oxygen to remove a portion of said hydrocarbon liquid, subsequently passing said treated agglomerates into a high velocity stream of steam to disintegrate said agglomerates into fine particles of coal and remove a further portion of said hydrocarbon liquid, and subsequently separating out said fine coal particles and condensing said steam and hydrocarbon liquid to allow recovery and recycling of said hydrocarbon liquid.

2. A method as in claim 1 and further comprising, altering the rate of production of fine coal particles in response to sensing means responsive to the demand for steam production to actuate changes in agglomerate feed rate and pressure and/or temperature of the steam in the fluidized bed.

3. A method as claimed in claim 1 wherein the coal agglomerates entering the fluidized bed are from 3 to 4 mm in size.

4. A method as claimed in claim 2 wherein the coal agglomerates entering the fluidized bed are from 3 to 4 mm in size.

5. A method as claimed in claim 1 wherein the fine coal particles are predominantly below 300 microns in size.

6. A method as claimed in claim 2 wherein the fine coal particles are predominantly 300 microns in size.

7. A method as claimed in claim 1 wherein the coal agglomerates residence time in the fluidized bed ranges from 6 to 12 minutes.

8. A method as claimed in claim 2 wherein the coal agglomerates residence time in the fluidized bed ranges from 6 to 12 minutes.

9. An apparatus for preparing fine coal particles for use in power generation, comprising means for feeding coal-hydrocarbon liquid agglomerates to a fluidized bed, said fluidized bed having at its lowest part an inlet for steam and in its upper portion an inlet for said coal agglomerates and an outlet for agglomerates intermediate the height of said fluidized bed, said outlet feeding said treated agglomerates into a tubular conveyor having a high velocity steam inlet at one end and a means for separating out fine coal particles from said steam at the other end.

10. Apparatus as claimed in claim 9 which includes control means comprising means responsive to steam production in a power generation plant, adapted to activate changes in production of coal agglomerates being fed to the fluidized bed and to actuate changes in the temperature and or pressure of the steam being fed to the fluidized bed to alter the rate of production of fine coal particles.

11. Apparatus as claimed in claim 9 which includes condensation means to separate steam from oil recovered from the disintegrated coal agglomerates and means to recycle the oil for use in the coal agglomeration plant.

12. Apparatus as claimed in claim 10 which includes condensation means to separate steam from oil recovered from the disintegrated coal agglomerates and means to recycle the oil for use in the coal agglomeration plant.

13. A method as claimed in claim 1 and further comprising:

passing said agglomerates out of a first portion of said fluidized bed into a second portion of said fluidized bed through a restricted outlet so that none of said agglomerates can avoid treatment in said fluidized bed; and passing said agglomerates out of said second portion of said fluidized bed into said high velocity stream through at least one restricted opening intermediate the height of said fluidized bed.

14. Apparatus as claimed in claim 9 wherein said fluidized bed comprises:

a first portion having said inlet for said coal agglomerates;

a restricted outlet in said first portion of said fluidized bed adjacent to said steam inlet providing a passageway for said agglomerates into a second portion of said fluidized bed so that none of said agglomerates can avoid treatment in said fluidized bed; and said outlet for agglomerates being located in said second portion of said fluidized bed.

* * * * *

UNITED STATES PATENT AND TRADEMARK OFFICE

CERTIFICATE OF CORRECTION

PATENT NO. : 4,539,010

DATED : September 3, 1985

INVENTOR(S) : David E. Mainwaring and Charles U. Jones

It is certified that error appears in the above—identified patent and that said Letters Patent is hereby corrected as shown below:

Cover page, Assignee line, delete "Australia Limited" and substitute therefor --B.P. Australia Limited--.

Signed and Sealed this

*Third* Day of *December 1985*

[SEAL]

*Attest:*

DONALD J. QUIGG

*Attesting Officer*

*Commissioner of Patents and Trademarks*